US006103200A

United States Patent [19]

Babashak

[11] Patent Number: 6,103,200

[45] **Date of Patent: *Aug. 15, 2000**

[54] ADAPTER ASSEMBLY FOR SCIENTIFIC GLASSWARE

[76] Inventor: John Babashak, 1211 Forest Dr., Millville, N.J. 08332

[ * ] Notice: This patent issued on a continued prosecution application filed under 37 CFR 1.53(d), and is subject to the twenty year patent term provisions of 35 U.S.C. 154(a)(2).

[21] Appl. No.: 09/099,030

[22] Filed: Jun. 17, 1998

[51] Int. Cl.[7] ..... B01L 11/00; B01L 3/00

[52] U.S. Cl. ..... 422/103; 422/99; 422/102

[58] Field of Search ..... 422/102, 103; 435/288.1, 304.1

[56] References Cited

U.S. PATENT DOCUMENTS

| | | | |
|---|---|---|---|
| 2,816,743 | 12/1957 | Kirkland | 422/103 |
| 2,981,439 | 4/1961 | Huffman . | |
| 3,311,275 | 3/1967 | Gibson . | |
| 3,323,874 | 6/1967 | Philips | 422/103 |
| 3,813,223 | 5/1974 | Fleck | 422/102 |
| 4,135,866 | 1/1979 | Winkler | 422/103 |
| 4,411,163 | 10/1983 | White | 422/102 |
| 4,566,509 | 1/1986 | Szajna . | |
| 4,809,870 | 3/1989 | Goodall . | |
| 5,060,827 | 10/1991 | Segati . | |
| 5,067,639 | 11/1991 | Maguire et al. . | |
| 5,139,182 | 8/1992 | Appla . | |
| 5,525,303 | 6/1996 | Ford et al. | 422/103 |
| 5,573,281 | 11/1996 | Keller . | |
| 5,811,060 | 9/1998 | Laguna Valderrama | 422/102 |

*Primary Examiner*—Jill Warden
*Assistant Examiner*—Dwayne K Handy
*Attorney, Agent, or Firm*—Robert L. Epstein; Harold James; James & Franlin, LLP

[57] ABSTRACT

The adapter assembly is used on a vessel having an opening defined by the rim of an externally threaded neck. PTFE inserts with different internal bore configurations are used. The inserts include a lower portion adapted to be received in the vessel opening and an upper portion adapted to extend above the rim. The portions are separated by the flange with the circumferential groove which rests on the rim. An O-ring is received in the groove. An internally threaded PBTP cap with a central opening fits over the insert and engages the threads of the neck. The cap has an internal wall which cooperates with the O-ring to seal the cap to the neck. The upper portion of the insert extends through the cap opening. The internal bore may be tapered to receive an inner taper joint or threaded to receive an externally threaded connector. An insert with multiple bores is capable of receiving several components.

21 Claims, 5 Drawing Sheets

22
B
44
62
64
58
A
60
40
52
50
54
42
56
36
38
48
49
12
10
C

ADAPTER ASSEMBLY FOR SCIENTIFIC GLASSWARE

This invention relates to glassware used for scientific and/or laboratory purposes and more particularly to an adapter assembly capable of providing gas tight connections between vessels on the one hand and various tubes and other functional accessories, on the other hand.

BACKGROUND OF THE INVENTION

Various operations performed with scientific or laboratory glassware require reaction vessels such as bottles, flasks and chromatography columns. These vessels have one or more openings designed to receive one or more of a variety of different tubes and functional accessories such as flow adapters, gas bubblers, funnels, probes, stirrers and the like.

The openings of the vessels can be of various sizes and shapes. They can be designed to receive tapered joints or screw connectors of different sizes. Tubes and accessories are provided with tapered joints or screw threads of many different sizes. Thus, a large inventory of different vessels, tubes and accessories are normally required to permit the connection of the combination of components necessary to construct different glassware configurations for varied applications.

The present invention is an adapter assembly which provides greatly increased flexibility of connection between the vessels and other components, thereby dramatically decreasing the number of different glassware items necessary to perform a wide variety of functions. Existing standard taper glassware can be connected to standard vessels with threaded necks using the adapter assembly to provide a gas tight seal. The adapter assembly uses a simple screw cap to secure the adapter inserts to vessels with large openings, which provide easy access to reaction products. A vessel with one size opening can be adapted to accomodate existing components with inner joints ranging from $^{10}/_{18}$to $^{29}/_{42}$by utilizing different adapter inserts.

Reactor/boiling flasks can be sealed with the screw cap portion of the assembly. This permits the contents of the flask to be stored after completing the reaction. Air sensitive chemistry, chromatographic techniques and freeze drying are possible with the adapter assemblies of the present invention. No expensive tooling or grinding is necessary. Moreover, the system does not require grease to effect the seal, thereby avoiding the possibility of contamination.

Adapter inserts designed for a variety of purposes can be utilized. They can be constructed to receive inner taper joints or externally threaded connectors. Single and three inlet versions are provided. Assemblies designed for stirring, lyophilization and vacuum control are also available.

The adapter assembly can convert plain stem funnels for vacuum filtration. It can provide a combination inlet and vent tube on a single neck vessel. It permits extension of a gas inlet or gas dispersion tube into a flask so as to function like an impinger. It can be used as a vent when used with additional funnels like a bubbler.

It is, therefore, a prime object of the present invention to provide an adapter assembly for use with scientific glassware to provide great flexibility in connecting a variety of components to reaction vessels.

It is another object of the present invention to provide an adapter assembly for use with scientific glassware which utilizes a simple structure to provide a gas tight seal.

It is another object of the present invention to provide an adapter assembly for use with scientific glassware which includes inserts with a variety of internal bore sizes and configurations.

It is another object of the present invention to provide an adapter assembly for use with scientific glassware which permits a vessel with a large opening to accept standard inner taper joints of a large variety of different sizes.

In accordance with the present invention, an adapter assembly is provided for use with a vessel having an opening defined by the rim of an externally threaded neck. The assembly includes an insert with an internal bore. The insert includes a first portion adapted to be received within the opening, a second portion adapted to extend above the rim and a flange separating the insert portions. The flange is adapted to be situated proximate the rim of the neck. The flange includes a circumferential groove. An O-ring is received within the groove. An internally threaded cap with a central opening is received over the insert and the neck to engage the threads of the neck. The cap has an internal wall which cooperates with the O-ring to seal the cap to the neck of the vessel. The second insert portion extends through the central opening the cap, so as to be accessible from the exterior of the assembly.

The assembly is designed for use with a tube having a standard taper inner joint. The internal bore of the insert is tapered to accept the joint.

The assembly is design for use with a tube having a wall. A clamp is provided to engaged the insert and the tube wall. A circumferential recess is provided on the second insert portion. The clamp includes means for engaging the recess. The clamp also includes means for engaging the tube wall.

The insert is preferrably composed of PTFE. The cap is preferrably composed of PBTP. It may have three internal bores. The insert may include a vent opening.

The internal bore may be threaded to accept an externally threaded connector. A stopper may be provided to be received in the insert in alignment with the central opening of the cap.

DESCRIPTION OF THE DRAWINGS

To these and to such other objects which may hereinafter appear, the present invention relates to an adapter assembly for use on scientific glassware as described in detail in the following specification, as set forth in the annexed claims and as illustrated in the accompanying drawings, in which like numerals refer to like parts, and wherein:

DESCRIPTION OF THE PREFERRED EMBODIMENTS

Figure 1:
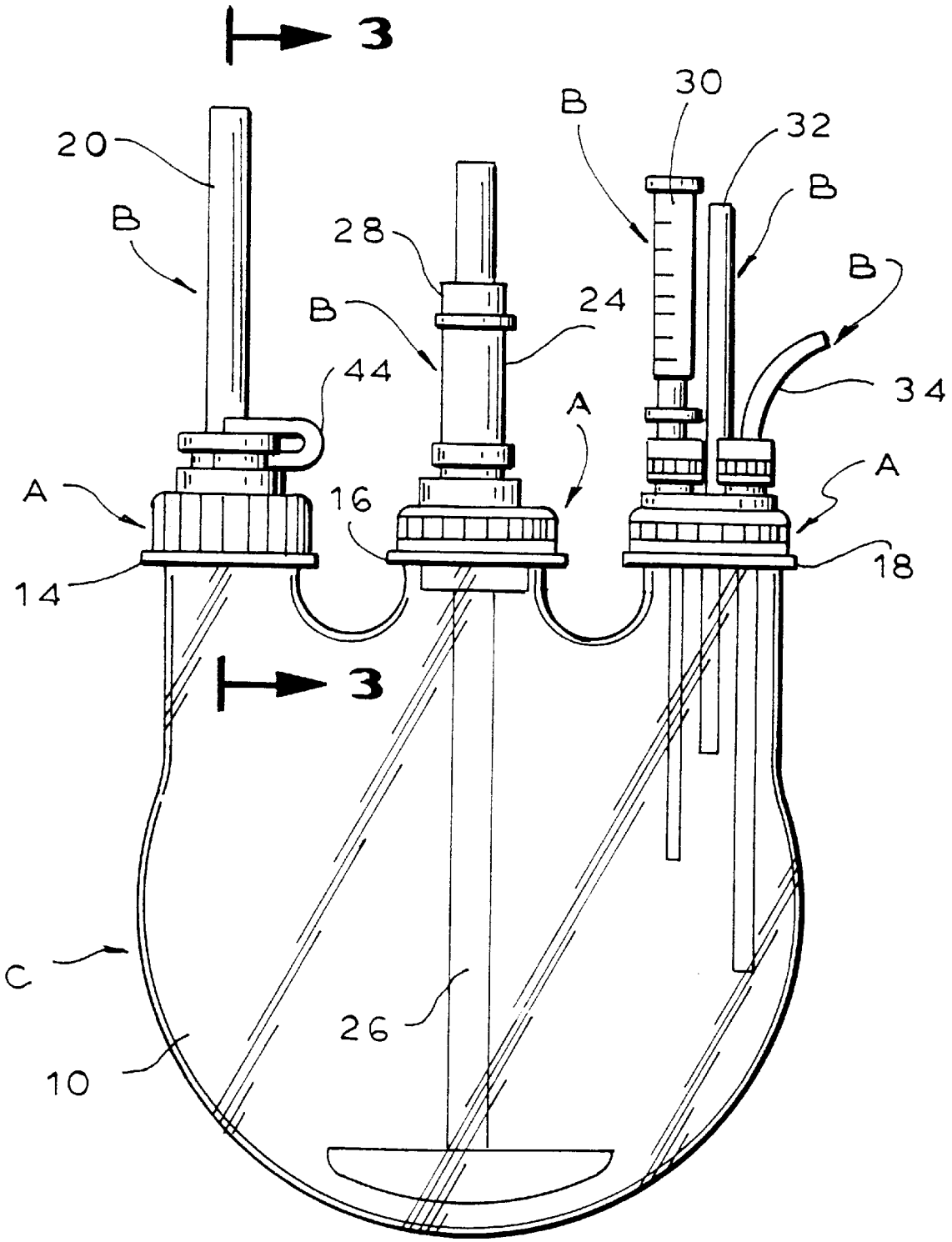
FIG. 1 is an elevational view of a three necked flask showing three different embodiments of the adapter assembly of present invention.

As shown in the drawings, the adapter assembly of the present invention, generally designated A, is designed to permit a number of different components, generally designated B, such as tubes with standard inner taper joints of a variety of different sizes or any of a plurality of functional accessories such as probes, thermometers, stoppers, funnels, stirrers and the like, to be connected to the opening of a reaction vessel, generally designated C, such as a flask.

FIG. 1 shows a typical round bottom, three vertical neck flask 10. Each neck is provided with external screw threads 12 and defines a relatively large opening. The large opening permits the easy removal of reaction products.

Each neck of the flask is shown with a different configuration adapter assembly 14, 16, 18 which have been selected to illustrate typical possible combinations of components. Adapter assembly 14 accepts a glass or plastic tube 20 with a standard taper joint 22. Adapter assembly 16 accepts a bearing 24 which is threaded at both ends and through which a stirrer 26 extends. A pair of PTFE shaft seals (not shown) and a top cap 28 form a stirrer assembly. Adapter assembly 18 has three inlet openings each with an internal bore. They are provided with a syringe 30 for adding reactant, a drying tube 32 and a piece of ⅛" PTFE tubing 34, respectively.

Other components could also be utilized. These include temperature probes, thermometers, addition funnels, coil condensers, lyophilization stoppers, gas bubblers, Buchner funnels and valves. These components either friction fit into the adapter assembly directly or utilize a lock nut (see FIG. 6) to secure the component to the adapter assembly. For example, the embodiment illustrated in FIG. 6 can be employed to support column packing materials used in chromatography. The adapter assembly has been used to make a solid phase peptide reaction vessel. Components can also be used to make a separatory funnel.

The adapter assembly can accept a wide variety of connection, reduction, enlargement, distillation and condensation glass parts with threaded tops and bottom inner joints from 10/18 to 29/42 in size. The assembly is capable of receiving all of these different size components by simply selecting the appropriate insert configuration.

Figure 2:
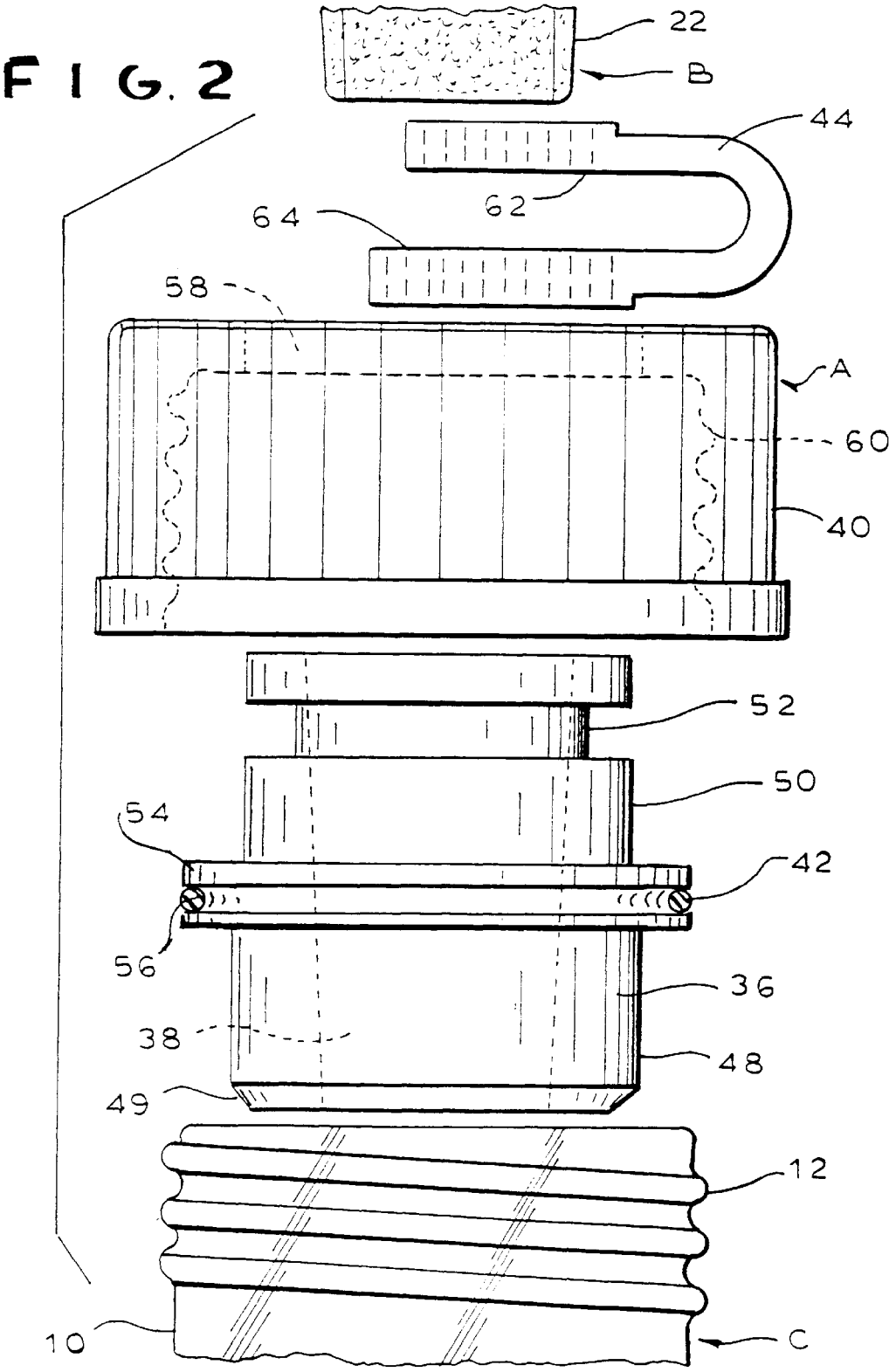
FIG. 2 is an enlarged exploded side view of the adapter assembly embodiment of FIG. 1 designed to accept a taper joint.
Figure 3:
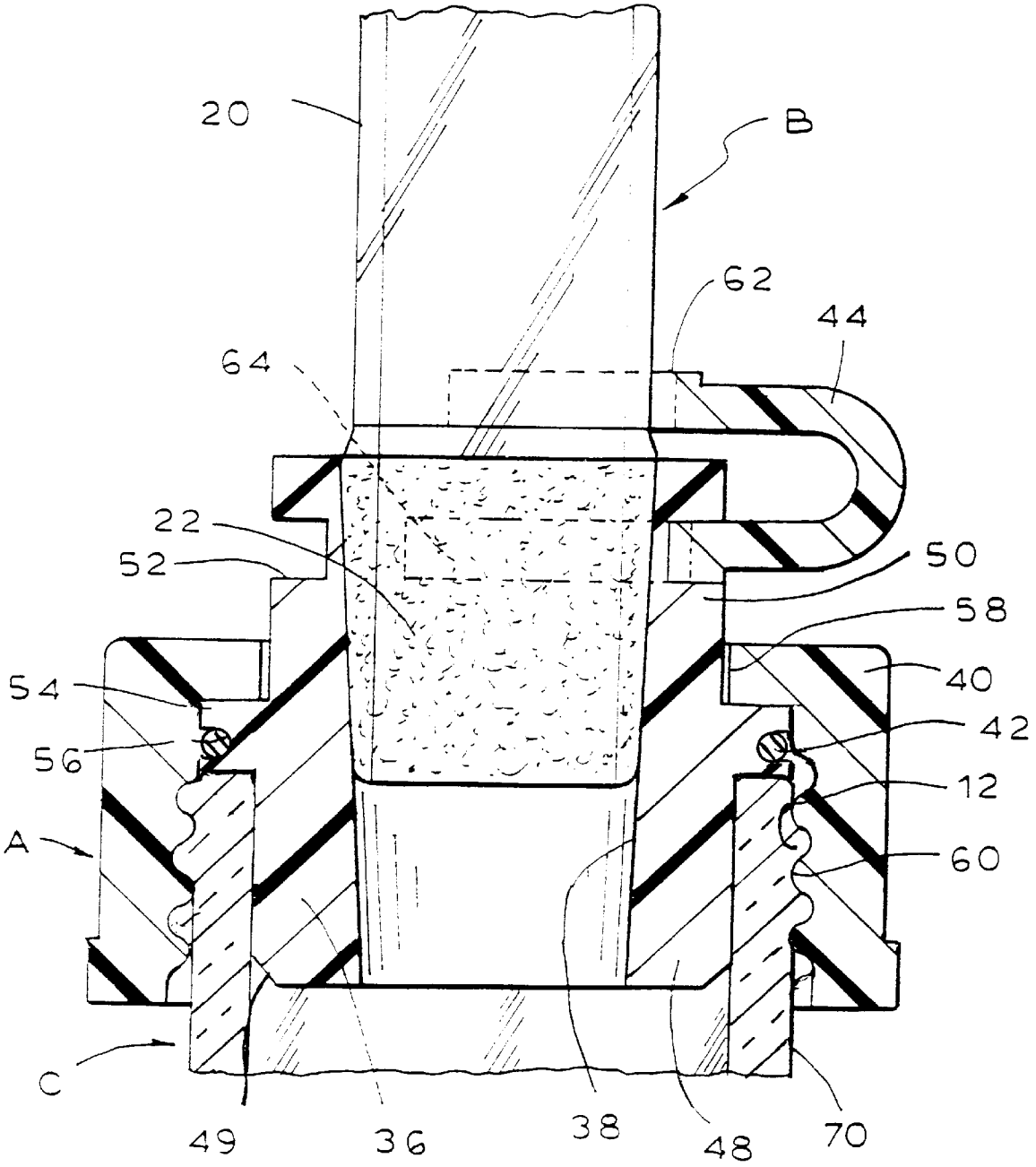
FIG. 3 is an enlarged cross-sectional view of the adapter taken along line 3—3 of FIG. 1.

As best seen in FIGS. 2 and 3, the basic adapter assembly comprises a PTFE insert 36 with one or more internal bores 38, an internally threaded PBTP cap 40 and a Viton O-ring 42. A polyacetal clamp 44 or a retainer lock nut 46 (FIG. 6) may also be utilized, depending upon the application.

Insert 36 is generally cylindrical in shape. It includes a lower portion 48 sized to fit snuggly into the neck of the vessel. Portion 48 has a beveled lower edge 49 to facilitate alignment. Upper portion 50 of insert 36 has a slightly smaller diameter than lower portion 48 and a circumferential recess 52 to accept clamp 44, as explained below.

Portions 48 and 50 are separated by a flange 54. Flange 54 has a circumferential groove 56 with a rounded surface designed to receive an O-ring 42. When the insert is received in the neck opening, flange 54 rests on the rim of the neck, preventing the insert from passing through the neck. The flange protects the O-ring from coming into contact with the fluid contents of the flask.

Cap 40 (preferrably 32 or 45 mm) has a central opening 58. Internal screw threads 60 are provided to engage the external screw threads 12 of the flask neck. The cap is received over the insert such that upper portion 48 extends through opening 58 and is accessible. The interior wall 60 of cap 40 cooperates with O-ring 42 to create a gas tight seal.

Internal bore 38 is sized and tapered to snuggly accept one of a variety of standard inner taper joints 22. Once the joint is received in the bore, clamp 44 is used to secure the joint bearing component to the adapter assembly.

Figure 4:
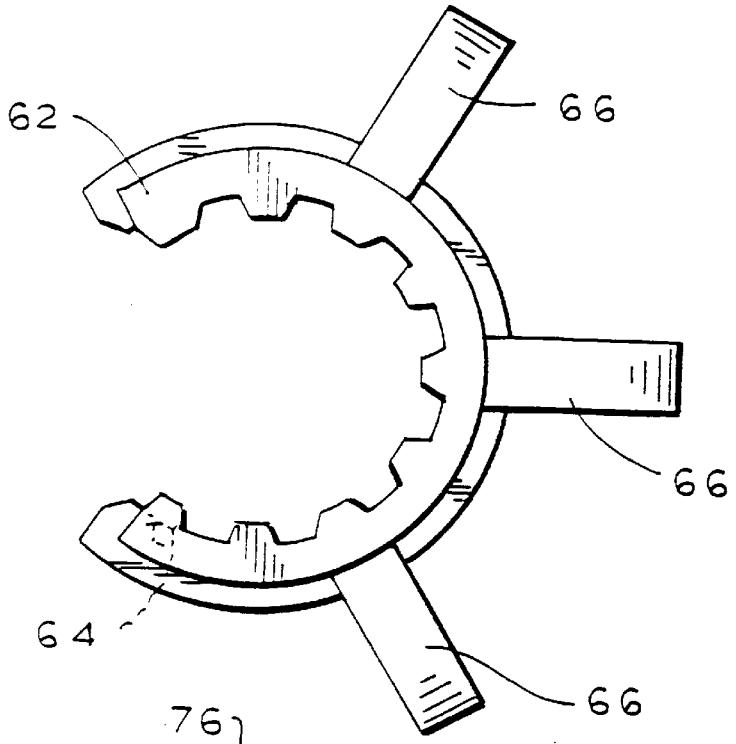
FIG. 4 is a top view of the clamp shown in FIG. 2.

Clamp 44 consists of two generally "U" shaped parts 62, 64 each with a series of radially inwardly extending teeth (see FIG. 4). Parts 62 and 64 are joined together by relatively rigid connecting portions 66 which keep the parts spaced a suitable distance.

Part 64 is designed to be received in circumferential recess 52 in upper portion 50 of insert 38 as it extends above the surface of cap 40. The inwardly extending teeth function to grip the inner wall of the recess.

Part 62 of the clamp defines a circular space which is equal in diameter to the outer diameter of the wall of the component with the taper joint which is being connected by the adapter assembly. Part 62 snaps around the component wall such that the inwardly extending teeth frictionally engage the component wall.

Figure 6:
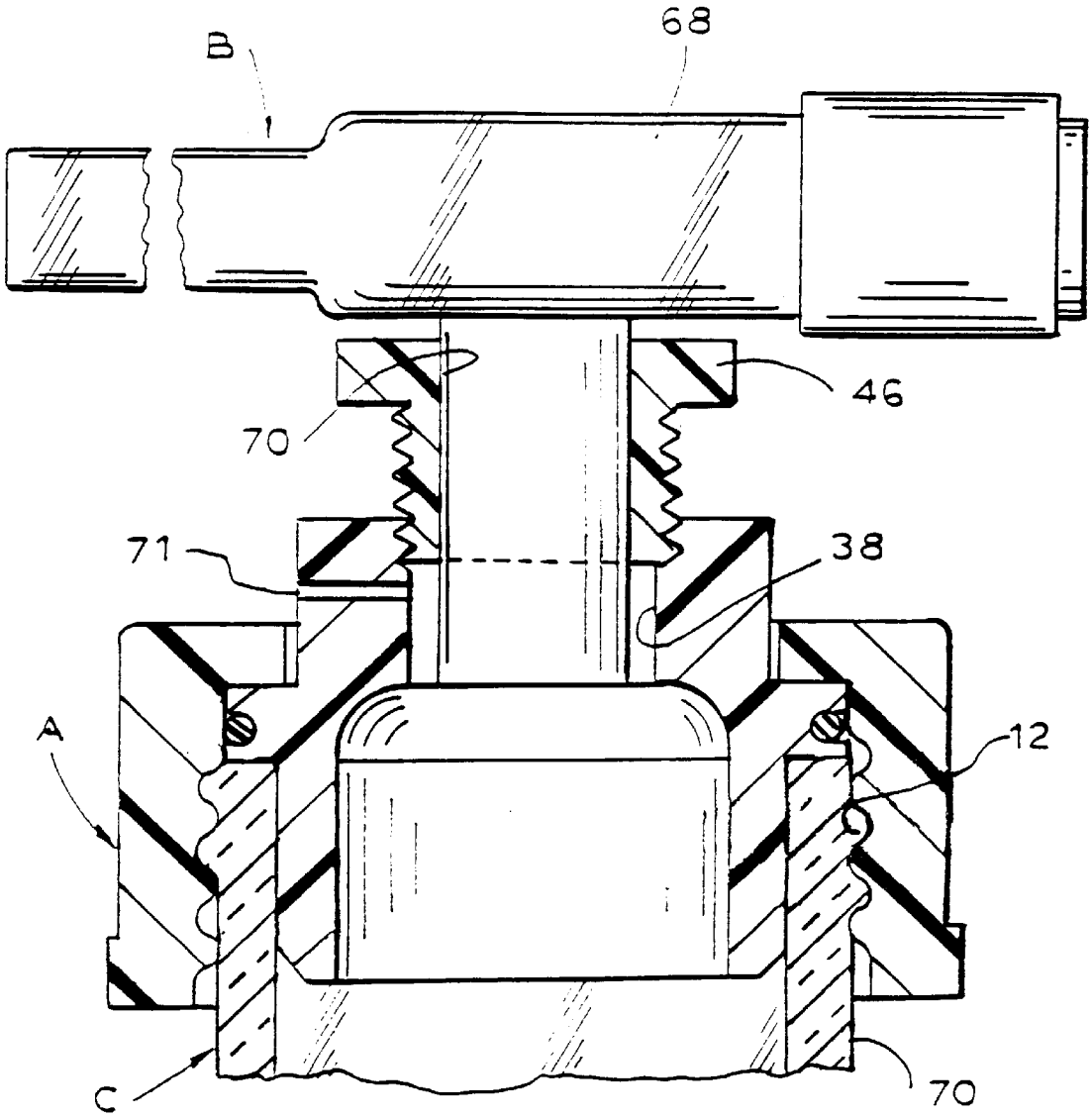
FIG. 6 is an enlarged cross-sectional view of another embodiment of the adapter assembly with a threaded bore which is useable with a chromatography column.

When components without taper joints are to be connected to the flask, such as that shown in FIG. 6 which includes a flow control valve 68 with a vented adaptor body or a probe or thermometer, bore 38 is internally threaded to accept an externally threaded lock nut 46 which has a central opening 70 designed to receive the valve stem. The adaptor body is vented at 71.

Figure 5:
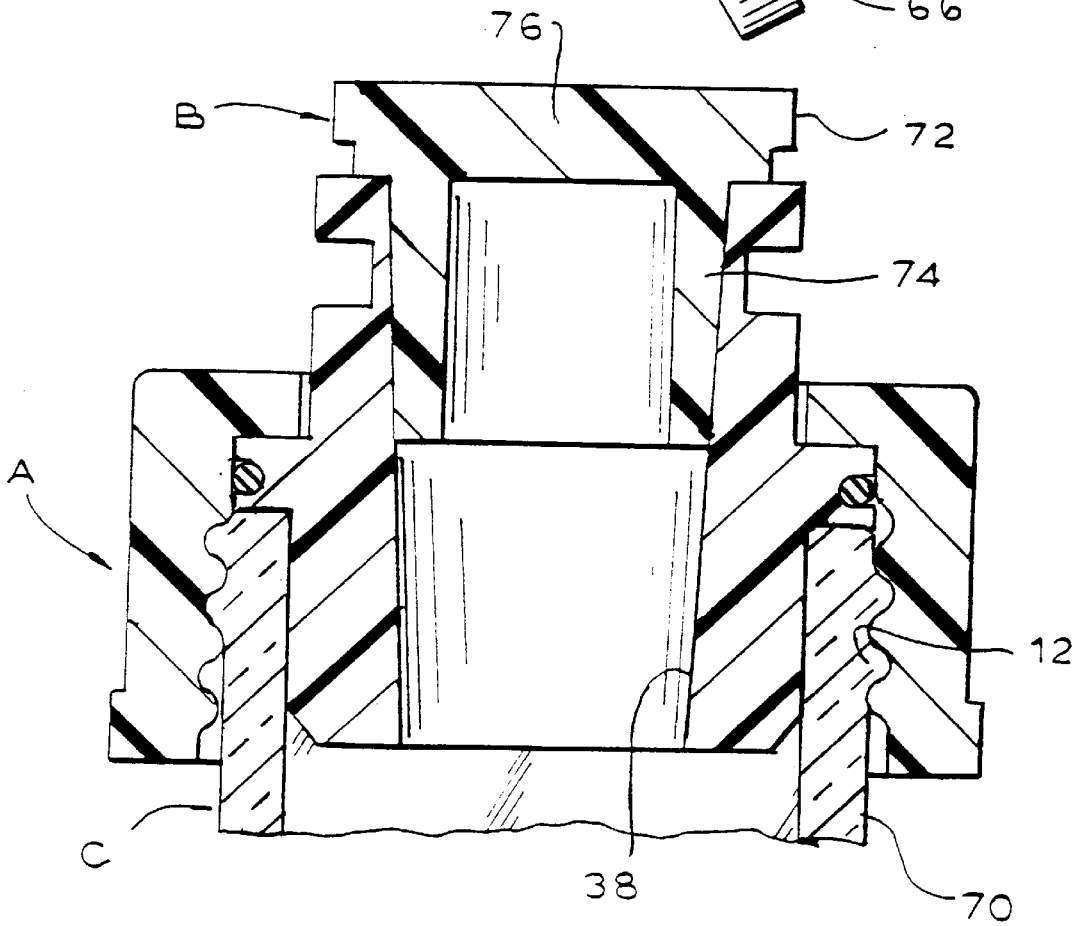
FIG. 5 is an enlarged cross-sectional view of an embodiment of the adapter assembly of the present invention including a stopper.

Alternately, a Lyophilzation stopper 72 as seen in FIG. 5 may be used to close the internal bore altogether. Stopper 72 has downwardly extending legs 74 which are received in the tapered bore 38 and an enlarged head 76 which completely seals the flask.

It should now be appreciated that the present invention is an adapter assembly designed to permit a large variety of different scientific glassware components, including those with a wide range of different size inner taper joints, to be sealingly connected to a reaction vessel with a large opening. Single and three inlet, stirring, Lyophilzation and vacuum adapter assemblies are provided. The adapter is suitable for use for air sensitive chemistry, chromatographic techniques and freeze drying.

The adapter assembly is formed of simple parts composed of conventional materials. Simple screw caps secure the inserts to the flask neck. A protected Viton O-ring is incorporated within the assembly to create a gas tight seal.

While only a limited number of preferred embodiments of the present invention have been disclosed herein for purposes of illustration, it is obvious that many modifications and variations could be made thereto. It is intended to cover all of these modifications and variations which fall within the scope of the present invention, as defined by the following claims:

I claim:

1. An adapter assembly for connecting the end of a component and a vessel of the type having an externally threaded neck with a rim, said assembly comprising an insert with an internal bore adapted to receive the component end and an outwardly extending flange having a circumferential groove, said flange dividing said insert into a first generally cylindrical insert portion and a second insert portion, said first insert portion being adapted to be received within the vessel neck, with said flange resting on said rim; an O-ring adapted to be received within said flange groove; and an internally threaded cap having an opening through which said second insert portion is adapted to extend and an internal wall, said internal cap wall cooperating with said O-ring to seal said insert to said cap, when said cap is received on and engages said neck.

2. The assembly of claim 1 for use with a component having a tapered inner joint, wherein said internal bore is tapered to accept the joint.

3. The adapter of claim 1 wherein said second insert portion comprises a circumferential recess.

4. The assembly of claim 1 for use with a component having a wall, further comprising a clamp adapted to engage said insert and the component wall.

5. The assembly of claim 4 further comprising a circumferential recess on said second insert portion.

6. The assembly of claim 5 wherein said clamp comprises means for engaging said recess.

7. The assembly of claim 4 wherein said clamp comprises means for engaging said component wall.

8. The assembly of claim 6 wherein said recess engaging means comprises a substantially "U" shaped recess engaging part.

9. The assembly of claim 8 wherein said recess engaging part comprises a plurality of inwardly extending teeth.

10. The assembly of claim 7 wherein said component wall engaging means comprises a substantially "u" shaped wall engaging part.

11. The assembly of claim 10 wherein said wall engaging part comprises a plurality of inwardly extending teeth.

12. The assembly of claim 5 wherein said clamp comprises a recess engaging part, a component wall engaging part and means for connecting said parts.

13. The assembly of claim 1 wherein said insert is composed of PTFE.

14. The assembly of claim 1 wherein said cap is composed of PBTP.

15. The assembly of claim 1 wherein said insert comprises three internal bores.

16. The assembly of claim 1 wherein said insert comprises a vent.

17. The assembly of claim 1 wherein said bore is internally threaded.

18. The assembly of claim 17 further comprising an externally threaded lock nut adapted to be received within said bore.

19. The assembly of claim 17 for use with a component having an externally threaded portion adapted to be received within said bore.

20. The assembly of claim 1 further comprising a stopper adapted to be received in said insert in alignment with said central opening of said cap.

21. An adapter assembly for connecting a component to a vessel having an opening defined by the rim of an externally threaded neck, the assembly comprising an insert with an internal bore adapted to receive the component, a first portion adapted to be received within the vessel opening, a second portion adapted to extend above the rim and a flange situated between said insert portions, said flange being adapted to be situated proximate the rim and comprising a circumferential groove, sealing means received within said groove, an internally threaded cap with a central opening, said cap being adapted to be received over said insert, in engagement with the threads of the neck, and having an internal wall adapted to cooperate with said sealing means to seal said insert to the neck of the vessel, wherein said bore is internally threaded and further comprising an externally threaded lock nut adapted to be received within said bore.

* * * * *